US005242107A

United States Patent [19]

De Nola

[11] Patent Number: 5,242,107

[45] Date of Patent: Sep. 7, 1993

[54] PAPERBOARD PACKAGES FOR FRAGILE ARTICLES

[76] Inventor: Robert C. De Nola, 209 Devonshire Ct., Pleasant Hill, Calif. 94523

[21] Appl. No.: 856,383

[22] Filed: Mar. 24, 1992

[51] Int. Cl.[5] ..... B65D 25/04

[52] U.S. Cl. ..... 229/120.26; 229/120.18; 229/120.21

[58] Field of Search ..... 229/120.18, 120.21, 229/120.24, 120.26, 120.29, 120.37; 206/45.14

[56] References Cited

U.S. PATENT DOCUMENTS

| | | | |
|---|---|---|---|
| 2,015,278 | 9/1935 | Meyer . | |
| 2,650,015 | 8/1953 | Frankenstein | 206/45.14 |
| 2,675,161 | 4/1954 | Buttery . | |
| 2,759,654 | 8/1956 | Vander Lugt, Jr. . | |
| 2,808,977 | 10/1957 | McCormick . | |
| 2,908,437 | 10/1959 | Wiedenmeier . | |
| 2,965,278 | 12/1960 | Phillips . | |
| 3,115,290 | 12/1963 | Byassee | 229/120.18 |
| 3,217,960 | 11/1965 | Davis . | |
| 3,232,513 | 2/1966 | Maio . | |
| 3,239,127 | 3/1966 | Spencer . | |
| 3,240,417 | 3/1966 | Andreini . | |
| 3,575,286 | 4/1971 | Rosenburg, Jr. | 229/120.18 |
| 3,698,544 | 10/1972 | Growney | 206/45.14 |
| 3,866,745 | 2/1975 | Dlugopolski . | |
| 4,026,411 | 5/1977 | Johnson . | |
| 4,037,717 | 7/1977 | Roccaforte | 206/45.14 |
| 4,101,022 | 7/1978 | Watkins . | |
| 4,143,763 | 3/1979 | Haglund . | |
| 4,264,006 | 4/1981 | Swanberg . | |
| 4,324,357 | 4/1982 | Murkowski . | |
| 4,438,848 | 3/1984 | Montealegre et al. | 206/45.14 |
| 4,583,677 | 4/1986 | Neese et al. | 229/120.26 |
| 4,609,104 | 9/1986 | Kasper et al. . | |
| 4,756,469 | 7/1988 | Hansen | 229/120.26 |
| 4,773,534 | 9/1988 | DeHeras et al. . | |
| 5,005,701 | 4/1991 | Dutcher | 206/45.14 |
| 5,088,601 | 2/1992 | Seefeldt . | |

*Primary Examiner*—Allan N. Shoap
*Assistant Examiner*—Christopher J. McDonald
*Attorney, Agent, or Firm*—Hughes & Multer

[57] ABSTRACT

A packaging apparatus having an interior structure for supporting an object and an exterior structure for protecting the object, comprising at least front, rear, left side, and right side panels, a glue flap connected to the right side panel, an opposing flap connected to the rear panel to which the glue flap is attached, a glue flap extension extending from the glue flap when the apparatus is unfolded for forming the interior structure when the apparatus is folded, and an opposing flap extension extending from the opposing flap for supporting at least a portion of the interior structure when the apparatus is folded.

13 Claims, 8 Drawing Sheets

PAPERBOARD PACKAGES FOR FRAGILE ARTICLES

TECHNICAL FIELD

The present invention relates to apparatus and methods for containing fragile objects during shipment and storage, and, more particularly, to such apparatus and methods that form an internal structure when erected in which objects may be stored.

1. Background of the Invention

Several general considerations govern the design of paperboard packages for containing fragile objects during shipment and storage First, paperboard packages should be designed such that they can be folded into an intermediate flattened configuration for shipment More specifically, the package is glued and preliminarily assembled at a first location into this intermediate or flattened configuration. Then, because the configuration of the package in this intermediate state is essentially flat, the package may be shipped to a second location cheaply and with low likelihood of damage thereto.

Additionally, a paperboard package should allow easy assembly from the intermediate configuration into a final expanded configuration. This final assembly should ideally be accomplished simply and without additional gluing and with relatively few folding steps.

Once it is in its final, expanded configuration, the package should allow simple insertion of product therein. When contained within the package during shipment and storage, the product should be isolated from the surrounding environment and protected from shocks, vibrations, and loads applied to the exterior of the package. It should be clear that the amount and type of isolation and protection required depends upon the type of product to contained.

It is also desirable that such packages be formed by appropriately folding a single sheet of paperboard. The single paperboard sheet may easily be formed by a cutting die. Further, use of a single sheet greatly simplifies assembly of the package into its intermediate and final configurations. The assembly of a paperboard package may thus easily be accomplished either by hand or by an automated assembly process.

The present invention is particularly advantageous when used in the design of paperboard packages for containing printed circuit (PC) boards sold to individuals because PC boards require high degrees of environmental isolation and shock, vibration, and load protection. That application will thus be discussed in detail below. However, the present invention has application to paperboard packages for containing other products as well. Accordingly, the scope of the invention should be determined based on the appended claims and not the following detailed discussion.

As indicated above, an PC board requires a relatively high degree of isolation from the external environment, including protection from dust, moisture, and electrostatic discharge. In the packaging industry, isolation from dust and moisture is primarily provided by plastic shrink wrap applied to the exterior of the paperboard package in which the PC board is contained. The exterior shape of the paperboard package should thus lend itself to shrink wrapping, and the package itself should at a minimum be strong enough to withstand any loads that should be applied thereto during the shrink wrapping process. Electrostatic isolation, on the other hand, is normally provided by material formed directly around the PC board. Both the PC board and the electrostatic isolation material are generally contained within both the paperboard package and the shrink wrapped plastic.

It should thus be clear that the primary function of the paperboard package is to protect the PC board from exterior shocks and loads which commonly occur during shipment. To accomplish this function, the paperboard package ideally comprises an exterior structure and an interior structure.

The main purpose of the interior structure is to support the PC board within the exterior structure. Specifically, the PC board should be so supported within the exterior structure that the PC board is spaced a minimum distance from each wall of the exterior structure. The interior structure should also prevent movement of the PC board within the package and should provide additional strength to the exterior structure, if possible.

The primary purpose of the exterior structure is to deflect or absorb shocks and to support loads. For example, if a light shock is applied to the package, the external structure should be strong enough to deflect this shock without damage to the package. If a larger shock is applied to the package, the external structure should deform and thus absorb the shock, but under anticipated loads should not deform sufficiently that the PC board is contacted and/or damage. If a static load is applied to the package, such as when a plurality of similar packages are stacked for display, the exterior structure should be of sufficient strength to absorb this load without deforming. Secondarily, the exterior structure should provide minimum protection from dust once the shrink wrap is removed.

Another important requirement for a package for PC boards is that a primary compartment should be created by the interior structure and one or more secondary compartments should also be created somewhere in the package for non-fragile secondary products such as: (a) documents such as a user manual, a warranty cards, and advertising materials; and (b) tools or other hardware necessary for installation of the PC board.

2. Prior Art

A search of the prior art uncovered the following U.S. patent applications: (a) No. 3,240,417 issued Mar. 15, 1966 to Andreini; (b) No. 2,808,977 issued Jan. 13, 1955 to McCormick; (c) No. 2,759,654 issued Aug. 21, 1956 to Vander Lugt, Jr.; (d) No. 3,217,960 issued Nov. 16, 1965 to Davis; (e) No. 5,088,601 issued Feb. 18, 1992 to Seefeldt; (f) No. 4,773,534 issued Sep. 27, 1988 to DeHeras et al.; (g) No. 4,609,104 issued Sep. 2, 1986 to Kasper et al.; (h) No. 4,324,357 issued Apr. 13, 1982 to Murkowski; (i) No. 4,264,006 issued Apr. 28, 1981 to Swanberg; (j) No. 2,675,161 issued Apr. 13, 1954 to Buttery; (k) No. 2,015,278 issued Sep. 24, 1935 to Meyer; (l) No. 2,908,437 issued Oct. 13, 1959 to Wiedenmeier; (m) No. 2,965,278 issued Dec. 20, 1960 to Phillips; (n) No. 3,232,513 issued Feb. 1, 1966 to Maio; (o) No. 3,239,127 issued Mar. 8, 1966 to Spencer; (p) No. 3,866,745 issued Feb. 18, 1975 to Dlugopolski; (q) No. 4,026,411 issued May 31, 1977 to Johnson; (r) No. 4,143,763 issued Mar. 13, 1979 to Haglund; and (s) No. 4,101,022 issued Jul. 18, 1978 to Watkins.

Of the foregoing patents, the patents (a)–(d), (h), and (n) to Andreini, McCormick, Vander Lugt, Jr., Davis, Murkowski, and Maio are most relevant because they to some extent disclose packages that have a protective exterior structure and a product supporting interior structure, may be folded into an intermediate, flattened configuration, and may be formed from a single sheet of paperboard. The remaining patents (e)-(g), (i)-(m), and (o)-(s) do not disclose at least one of these features and are disclosed herein as background information.

The package disclosed in the Andreini patent fails to provide adequate strength to the interior structure and internal support to the external structure. The Andreini package also does not provide additional secondary product storage compartments.

The McCormick package utilizes extensions off of a horizontal panel that render the manufacturing thereof relatively difficult. Specifically, the equipment required to manufacture this package must be relatively complex because the extended panels must fold in direction opposite to the direction of travel during assembly before the main panels may be glued.

The Vander Lugt, Jr. package is designed for round, not rectangular, objects does not provide additional secondary product storage compartments. Further, the use of this package with PC boards is limited because: (a) air s are created therein only when the length and width of the package are very different in size; and (b) the package fails to provide sufficient load bearing strength to the exterior structure thereof.

The Davis package design is also designed for round, rather than rectangular, products and also is limited to packages in which the length is very different from the width. This package design also fails to provide additional secondary product storage compartments.

The Murkowski design fails to provide: (a) an adequate internal structure for preventing movement of an object such as a PC board; and (b) sufficient strength to the exterior structure thereof for for all possible stacking conditions. This design also fails to provide separate compartments for the storage of secondary products.

The Maio package has the same fundamental flaws as the Vander Lugt, Jr. and Davis packages and is thus may not be used to contain objects such as PC boards.

OBJECTS OF THE INVENTION

In view of the foregoing, it is apparent that an important object of the present invention is to provide improved apparatus and methods for containing objects during shipment.

Another important, but more specific, object of the present invention is to provide packaging apparatus and methods having a favorable mix of the following factors:

a. constructed from a single sheet of die cut paperboard;

b. comprising both an interior and exterior structure;

c. allowing the package to be folded into an intermediate, flattened condition for storage;

d. providing adequate support for maintaining the interior structure within the exterior structure;

e. providing a strong exterior structure that does not transmit shocks to the object to be packaged and that supports loads applied to the apparatus;

f. allowing inexpensive, automated initial assembly into the intermediate flattened configuration;

g. allowing easy, inexpensive final assembly into the final, expanded configuration from the intermediate configuration; and h. allowing easy insertion of product therein.

SUMMARY OF THE INVENTION

These and other objects are achieved by the present invention, which is basically a packaging apparatus having an interior structure for supporting an object and an exterior structure for protecting the object, comprising at least front, rear, left side, and right side panels, a glue flap connected to the right side panel, an opposing flap connected to the rear panel to which the glue flap is attached, means extending from the glue flap when the apparatus is unfolded for forming the interior structure when the apparatus is folded, and means extending from the opposing flap for supporting at least a portion of the interior structure when the apparatus is folded.

Ideally, the glue flap extending means and the opposing flap extending means are connected within the exterior structure. From this connection, the opposing flap extending means is attached to at least one of the panels and the glue flap extending means is attached to at least another of the panels.

Preferably, at least one of the glue flap extending means and opposing flap extending means separates from the panel to which it is attached when the apparatus is folded.

DETAILED DESCRIPTION OF THE PREFERRED EMBODIMENT

Figure 1:
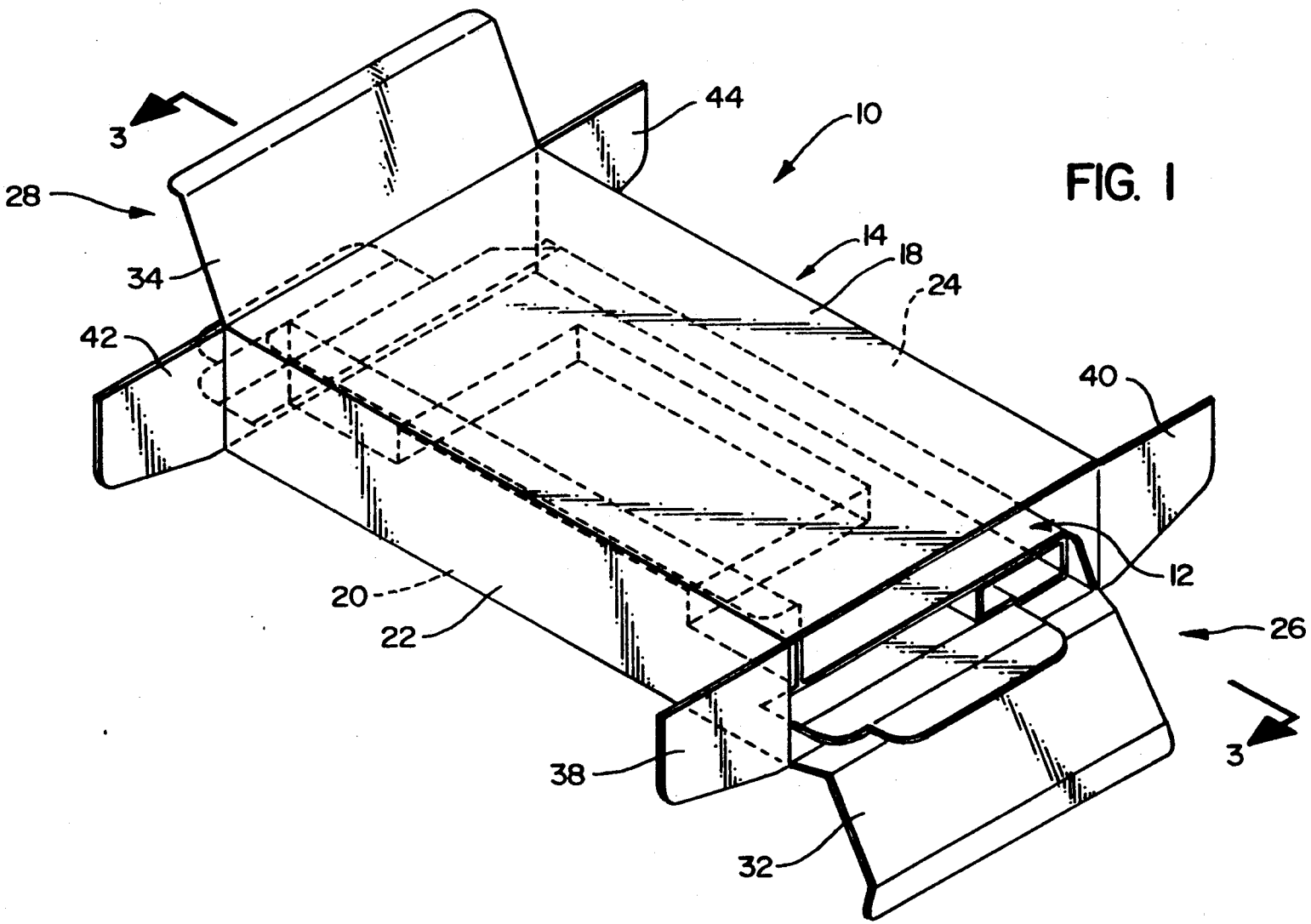
FIG. 1 is a perspective view of a paperboard package constructed in accordance with the present invention.
Figure 2:
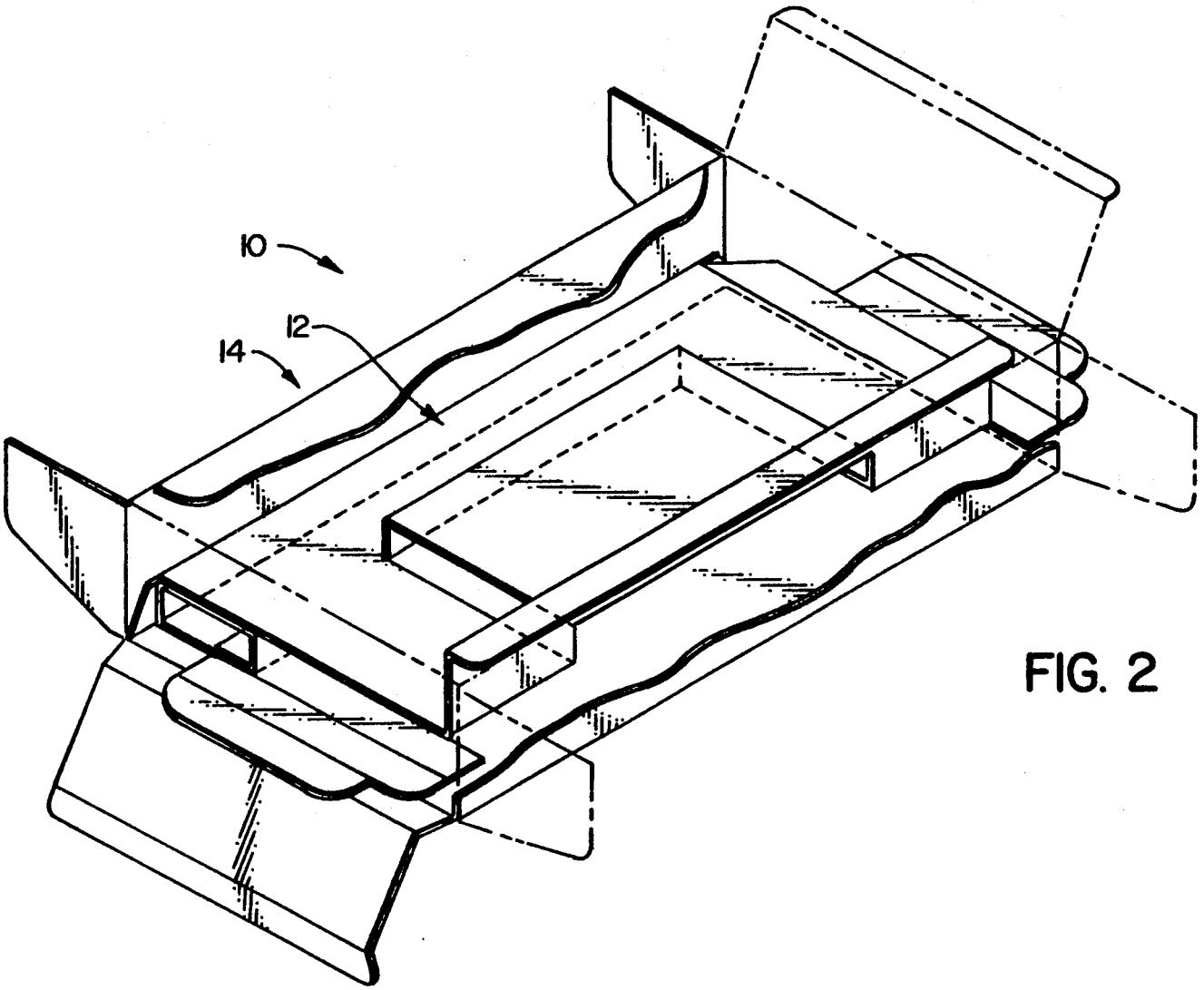
FIG. 2 is a perspective, cut-away view of a paperboard package of the present invention depicting the interior structure thereof.
Figure 3:
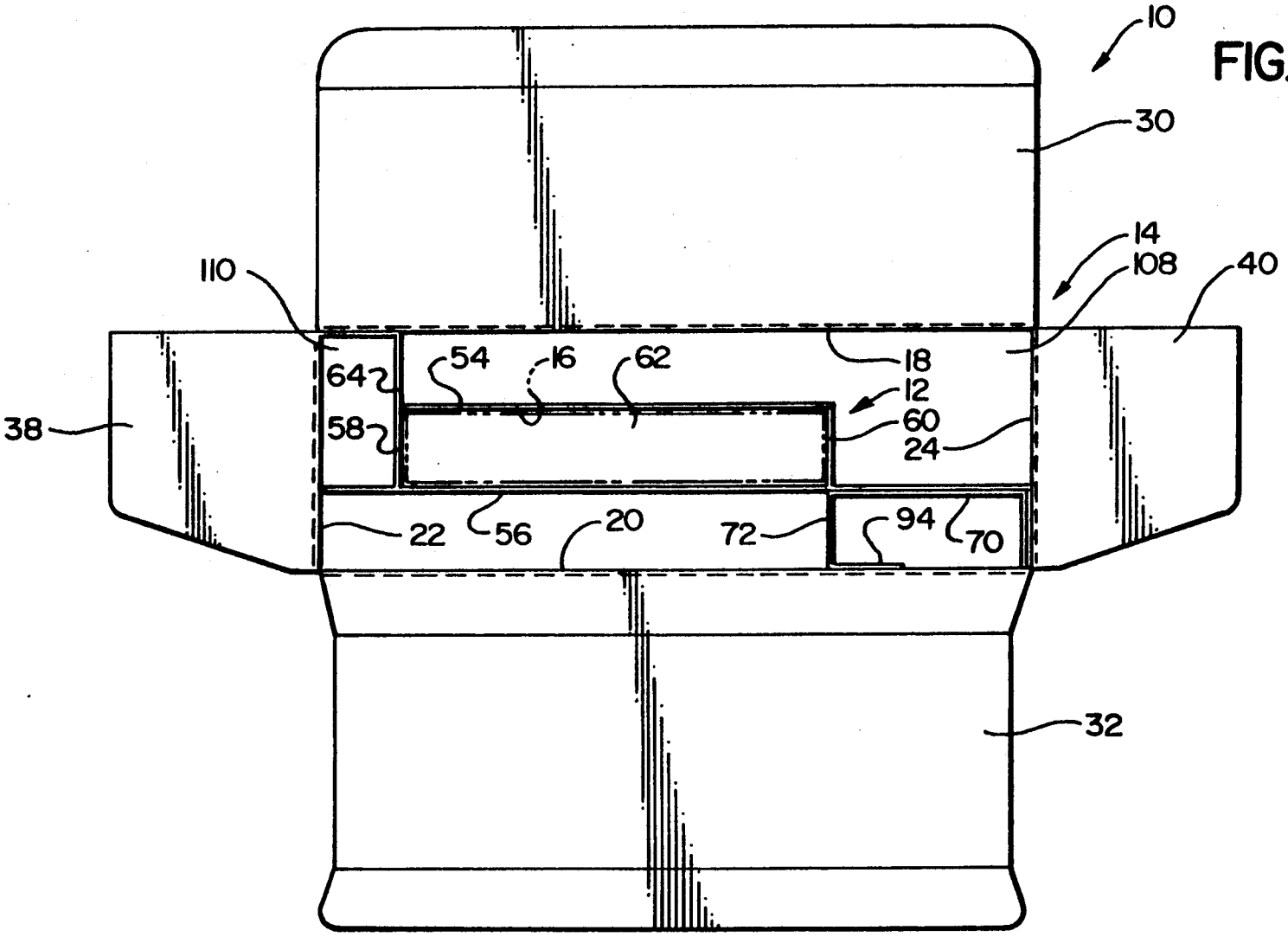
FIG. 3 is an end view of the present invention depicting the interior structure thereof.
Figure 4:
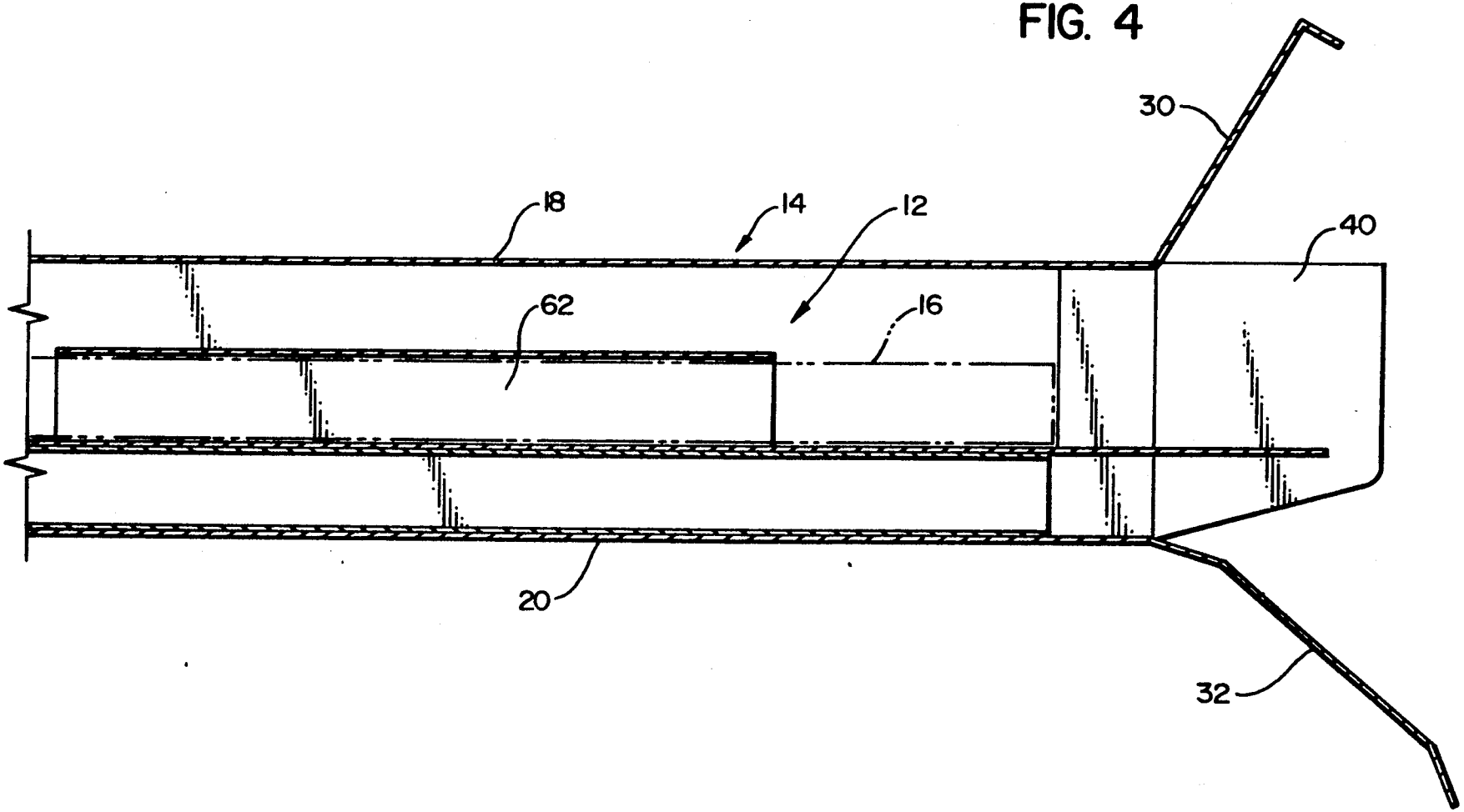
FIG. 4 is a side cut-away view taken along line 3 in FIG. 1.

Turning now to the drawing, a paperboard package constructed in accordance with, and embodying, the principles of the present invention is depicted at 10 in FIGS. 1-3. This package 10 basically comprises an interior structure generally depicted at 12 and an exterior structure generally depicted at 14. The interior structure 12 is adapted to secure within the package 10 a PC board that is schematically depicted at 16 in FIG. 3. The PC board 16 will normally be encased in antistatic material and will be generally rectangular in configuration.

Figure 11:
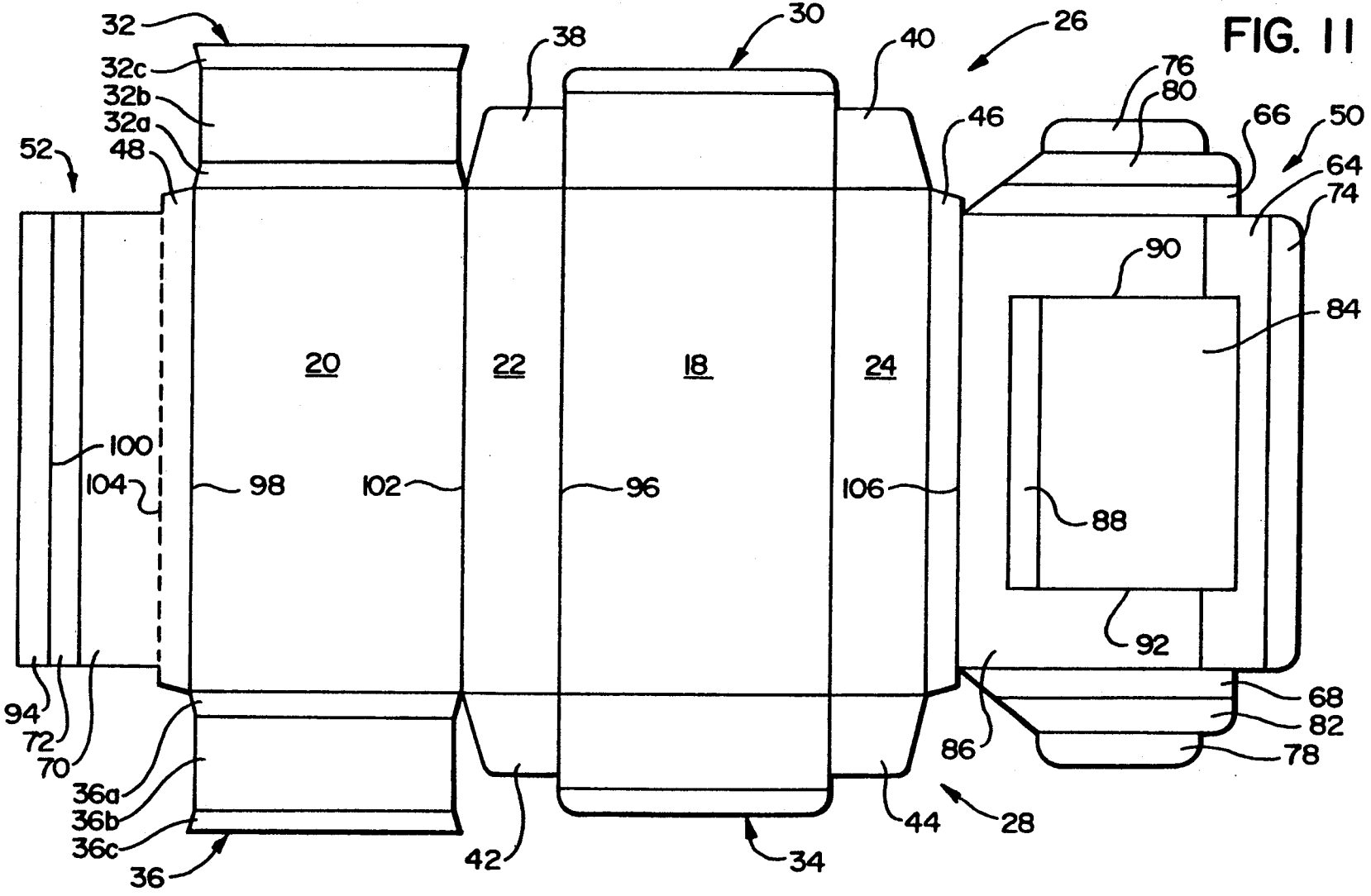
FIG. 11 depicts the present invention in its unfolded form prior to assembly into its intermediate, flattened position.

Referring back to FIG. 1, exterior structure 14 of the package 10 basically comprises a front panel 18, a back panel 20, a left side panel 22, and a right side panel 24. The package 10 has upper and lower ends generally indicated at reference characters 26 and 28, respectively. Referring now for a moment to FIG. 11, at the upper end 26 an outer top closure panel 30 is attached to the front panel 18 and an inner top closure panel 32 is attached to the rear panel 20. At the lower end 28, an outer bottom closure panel 34 is attached to the front panel 18 and an inner bottom closure panel is attached to the rear panel 20. For purposes of clarity, only the inner top closure panel 32 and outer bottom closure panel 34 are depicted in FIGS. 1 and 2.

Dust flaps 38, 40, 42, and 44 are located at the upper left, upper right, lower left, and lower right corners, respectively, of the package 10.

The various closure panels and dust flaps allow the ends 26 and 28 of the package 10 to be closed. When these ends 26 and 28 are so closed, the outer closure panels 30 and 34 and dust flaps 38–44 form a part of the exterior structure 14.

At this point it should be noted that in the following discussion the terms "upper, top", "lower, bottom", "left", "right", "inner, interior", and "outer, exterior" will be used to refer to those directions in the drawing corresponding to the naming conventions employed above. Also, in the following discussion of FIG. 11, it should be noted that, unless otherwise indicated, all lines depicted thereon indicate creases formed by a die stamping process to allow the paperboard from which the package 10 is formed to be folded as appropriate.

Attached to the right side panel 24 is a glue flap 46 and attached to the rear panel 20 is an opposing flap 48. The glue flap 46 and opposing flap 48 are perhaps best shown in FIG. 11. (FIG. 11 depicts the package 10 after it has been cut from a paperboard blank and prior to folding.) The package 10 further comprises a glue flap extension attached to the glue flap 46 and generally indicated in the drawing by reference character 50. The package 10 also comprises an opposing flap extension attached to the opposing flap 48 and generally indicated by reference character 52.

As is perhaps best shown in FIG. 3, the interior structure 12 basically comprises a front bounding wall 54, a rear bounding wall 56, a left bounding wall 58, and a right bounding wall 60. The interior structure 12 further comprises upper and lower bounding walls formed by the inner top and bottom closure panels 32 and 36 as will be discussed in detail below. These bounding walls define a primary cell 62 in the shape of a rectangular solid the dimensions of which closely match the exterior dimensions of the PC board 16. As will be described in detail below, the PC board 16 is inserted into this primary cell 62 when the board 16 is to be contained by the package 10.

Of importance to the present invention is the manner in which the interior structure 12 is formed and supported. The interior structure 12 is formed primarily from the glue flap extension 50 and is supported both by portions of the glue flap extension 50 and by portions of the opposing flap extension 52. More specifically, as shown in FIGS. 1–4, a first portion 64 of the glue flap extension 50 is connected between the interior structure 12 and the exterior structure front wall 18. Second and third portions 66 and 68 of this glue flap extension 50 extend between the interior structure 12 and the exterior structure left side wall 22. Additionally, a first portion 70 of the opposing flap extension 52 is connected between the interior structure 12 and the exterior structure right side wall 24, while a second portion 72 of this opposing flap extension 52 extends between the interior structure 12 and the exterior structure rear wall 20. The portions 64–68 of the glue flap extension 50 and the portions 70 and 72 of the opposing flap extension 52 are best shown in FIG. 11.

The interior structure 12 of the present invention is therefore supported on its front, back, left, and right sides. This support maintains the interior structure 12 at a fixed location within the exterior structure 14. Additionally, by supporting the interior structure 12 as described above, additional strength is provided to the exterior structure 14 which allows the exterior structure 14 to withstand greater externally applied shocks and loads.

Certain other portions of the glue flap extension 50, opposing flap extension 52, and inner closure panels 32 and 36 are important and will now be described. Specifically, a fourth portion 74 of the glue flap extension 50 allows the first portion 64 thereof to be attached to the exterior structure front wall 18. As shown in FIG. 3, the dimensions of this fourth portion 74 also should be such that the fourth portion 74 spaces the first portion 64 from the exterior structure left side wall 22 so that the interior structure left bounding wall is parallel to the exterior structure left side wall 22 when the box is fully assembled as shown in FIGS. 1–3.

Figure 7:
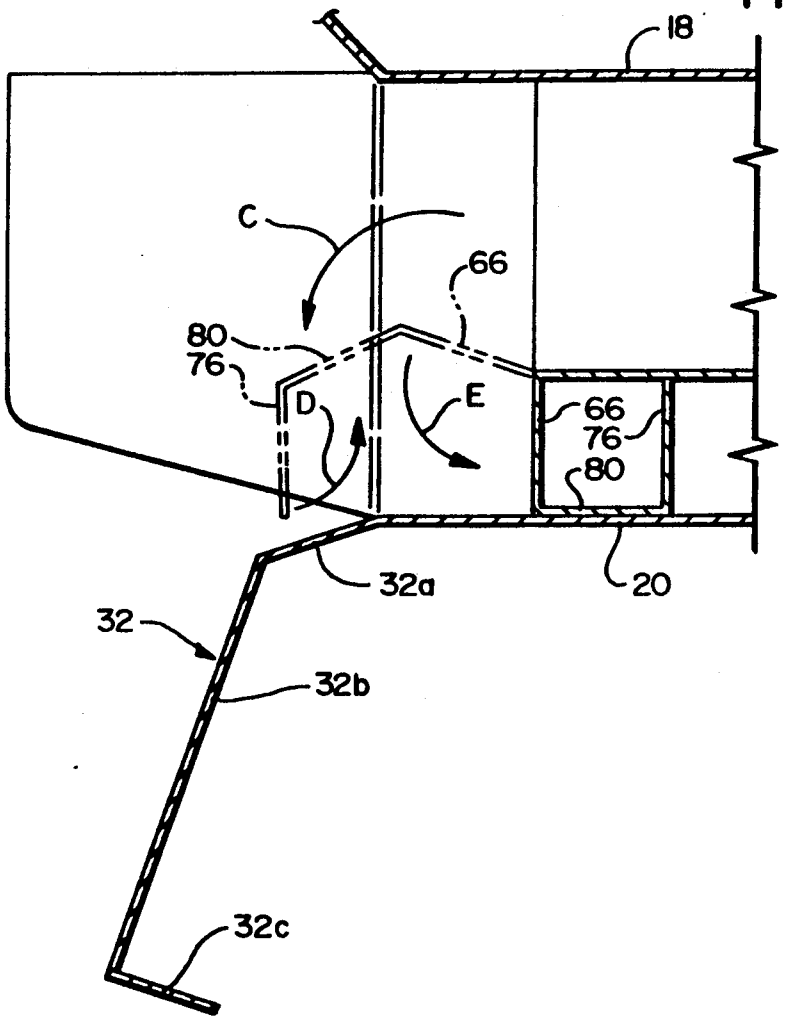
FIG. 7 is a partial, side cut-away view showing details of the assembly of the present invention.

Fifth and sixth portions 76 and 78 (FIGS. 7 and 11) of the glue flap extension 50 are formed to provide additional support to the interior structure rear bounding wall 56. These fifth and sixth portions 76 and 78 are connected to the second and third portions 66 and 68 by seventh and eighth portions 80 and 82, respectively. As shown in FIG. 7, these portions 76 and 78 (only portion 76 is depicted in FIG. 7) are inwardly folded so that they extend between the exterior structure rear wall 20 and the interior structure bottom wall 56.

The glue flap extension 50 also comprises a front wall portion 84, a rear wall portion 86, and a side wall portion 88. The lines in FIG. 11 identified by reference characters 90 and 92 are not fold lines but are openings cut into the paperboard from which the package 10 is constructed. Accordingly, when the package 10 is folded as shown in FIGS. 1 and 2, the portions 84 and 86 occupy separate parallel planes and the portions 64 and 88 occupy separate parallel planes. It should be clear that the bounding walls 54, 56, 58, and 60 are formed by at least part of the glue flap extension portions 84, 86, 64, and 88, respectively.

Referring now to the opposing flap extension 52, this extension 52 further comprises a third portion 94 attached to the second portion 72 thereof. This third portion 94 allows the opposing flap extension to be glued to the exterior structure bottom rear wall 20 as shown in FIG. 3.

Figure 8:
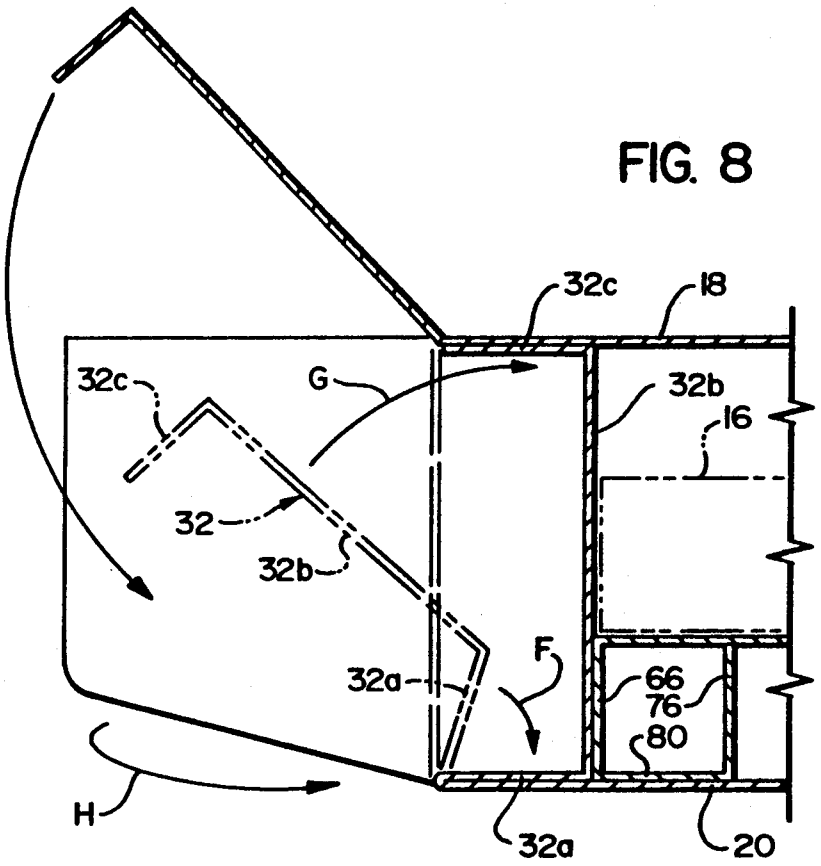
FIG. 8 is a partial, side cut-away view showing details of the assembly of the present invention.

The above-mentioned inner top and bottom closure panels 32 and 36 will now be discussed in further detail. These panels 32 and 36 each comprise inner, middle, and outer portions 32*a,b,c* and 36*a,b,c*. As shown in FIG. 8, these panels 32 and 36 (only panel 32 shown in FIG. 8) are folded inwardly so that the inner and outer portions 32*a,c* and 36*a,c* contact and are parallel to the exterior structure front and rear walls 18 and 20 (shown by solid lines in FIG. 8). In this position, the middle portions 32*b* and 36*b* are perpendicular to these walls 18 and 20. Parts of these middle portions 32*b* and 36*b* form the above-mentioned upper and lower bounding walls of the primary cell 62 in which the PC board 16 is contained.

The package 10 of the present invention is constructed and assembled as follows. Initially, a blank is die cut to obtain the folded out paperboard shape depicted in FIG. 11. The glue flap 46 is folded towards the opposing flap 48 along a seam 94 and glued to the right side panel. The fourth portion 74 of the glue flap extension 50 is then glued to the front panel 18 near a seam 96 between the front and left side panels 18 and 22. The opposing panel 48 and opposing flap extension 52 are then folded towards the glue flap 46 along a seam 98. The third portion 94 of the opposing flap extension 52 is folded underneath the second portion thereof along a seam 100 and glued to the rear panel 20. The rear panel 20 is then folded towards the front panel 18 along a seam 102. At this point, (a) the opposing flap 48 is glued to the glue flap 46; and (b) the first portion 70 of the opposing flap 52 is glued to the glue flap extension bottom wall portion 86. It should be clear that this initial assembly process may easily be automated.

Figure 5:
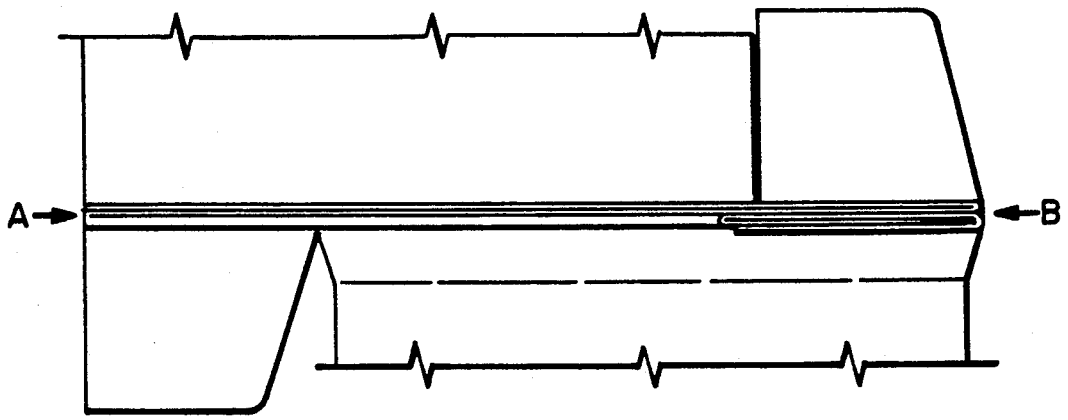
FIG. 5 is an end view of the paperboard package depicted in FIG. 1 in its intermediate flattened configuration.

At that point, the package 10 is in an intermediate flattened condition as depicted in FIG. 5. In this flattened condition, the package 10 may easily, cheaply, and safely be transported to the place where the PC board 16 is to be inserted therein.

Figure 6:
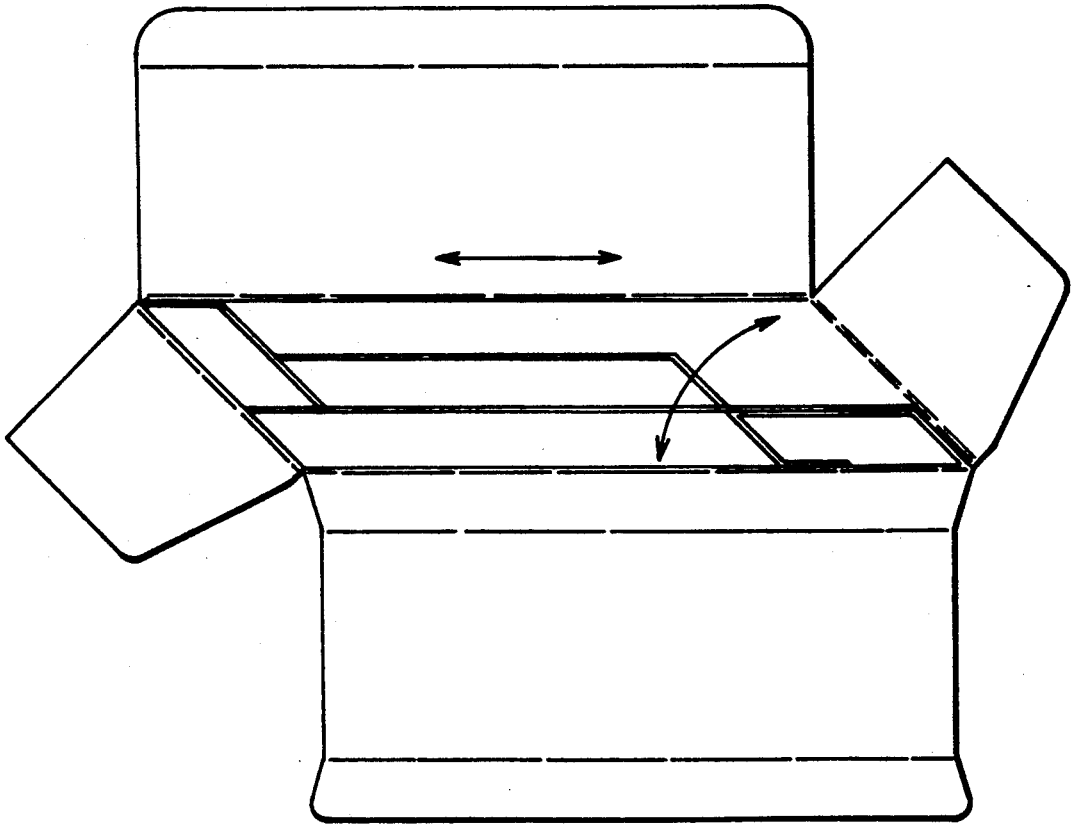
FIG. 6 is an end view of the paperboard package depicted in FIG. 1 moving from its intermediate flattened configuration to its final, expanded position.

Prior to insertion of the PC board 16, the package 10 undergoes a final assembly process. To change the package 10 from the flattened condition depicted in FIG. 5 to the opened configuration depicted in FIGS. 1–4, force is applied to the package 10 in its intermediate flattened condition in the direction of arrows A and B in FIG. 5 while the exterior structure front and rear panels 18 and 20 are being separated. This final assembly process is normally performed by hand. FIG. 6 depicts the package 10 moving from its intermediate state into its final state.

An important aspect of the invention occurs as the package 10 moves from its intermediate flattened configuration to its final opened configuration. As the package 10 is so moving, the opposing flap extension first portion 70 bends along a seam 104. However, if a seam 106 between the glue flap extension 50 and the glue flap 46 is a normal folding seam, this seam 106 will not allow the glue flap extension 50 to rotate as necessary to obtain a 90° angle between the glue flap 46 and the glue flap extension bottom wall portion 86.

Figure 9:
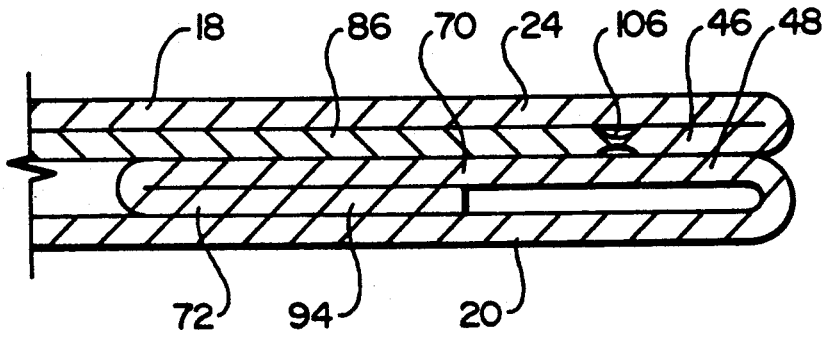
FIGS. 9 and 10 are side cut-away views of a detail of the present invention as the invention moves from its intermediate flattened configuration into its final, expanded position.
Figure 10:
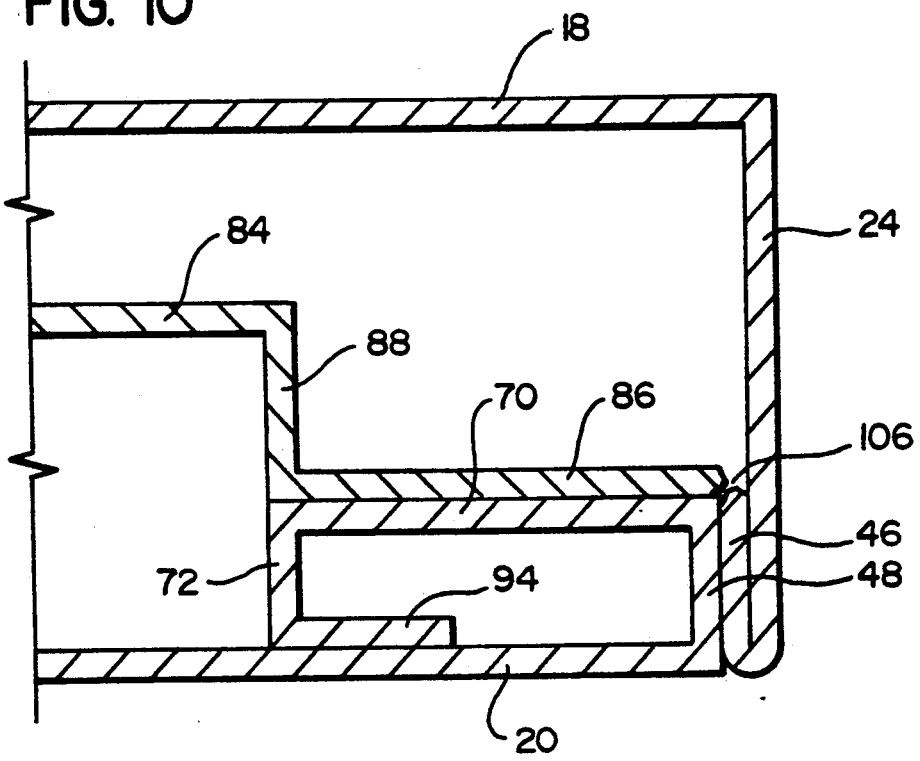

Accordingly, in the present invention, the seam 106 about which the glue flap extension 50 must bend is so perforated that the internal stresses created in the paperboard at this seam 106 when the package 10 moves between its intermediate and final configurations cause glue flap extension 50 to separate from the glue flap 46. This process is shown in FIGS. 9 and 10. In FIG. 9 showing a portion of the package 10 in its intermediate configuration, this seam 106 is unbroken. In FIG. 10, which depicts the package 10 in its final configuration, the seam 106 has been broken to allow the glue flap extension bottom wall portion 86 to extend at a 90° angle from the side wall 24.

At this point, the fifth and sixth portions 76 and 78 of the glue flap extension 50 are folded inwardly as indicated by arrows C, D, and E in FIG. 7 to the position shown by solid lines in that figure. One end of the primary cell 62 is then closed by first folding one of the inner closure panels 32 and 36 as shown by arrows F and G in FIG. 8. The dust panels associated with the closed end of the primary cell 62 are then folded inwardly as indicated by arrow H in FIG. 8. One end of the package is then closed by folding the associated outer closure panel 30 or 34 as indicated by arrow I in FIG. 8.

The PC board 18 is then inserted into the open end of the primary cell 62 so that the board 18 is held by the bounding walls 54–60 and the bounding wall formed by one of the inner closure panels 32 and 36. The other of the inner closure panels 32 is then folded inwardly as shown in FIG. 8 to close off the other end of the primary cell 62. The remaining dust flaps and outer closure panels are then folded as shown in FIG. 8 to close the PC board 16 within the package 10. The package 10 so closed is rectangular in shape and may easily be shrink-wrapped in plastic.

It should be noted that secondary cells such as cells 108 and 110 (FIG. 3) are created within the package 10 of the present invention. These cells 108 and 110 may be used to store and ship documentation and any ancillary equipment that may be required for the installation of the PC board 16.

It should be clear that the present invention may be embodied in forms other than that described above. The above-described embodiment is therefore to be considered in all respects illustrative and not restrictive, the scope of the invention being indicated by the appended claims rather than the foregoing description. All changes that come within the meaning and scope of the claims are intended to be embraced therein.

I claim:

1. A packaging apparatus having an interior structure for supporting an object and an exterior structure for protecting the object, the packaging apparatus comprising at least front, rear, left side, and right side panels, a glue flap connected to the right side panel, an opposing flap connected to the rear panel to which the glue flap is attached, means extending from the glue flap when the apparatus is unfolded for forming the interior structure when the apparatus is folded, and means extending from the opposing flap for so supporting at least a portion of the interior structure when the apparatus is folded that the interior structure is spaced on all sides from the exterior structure.

2. An apparatus as recited in claim 1, in which the glue flap extending means and the opposing flap extending means are connected within the exterior structure.

3. An apparatus as recited in claim 1, in which the opposing flap extending means is attached to at least one of the panels and the glue flap extending means is attached to at least another of the panels.

4. An apparatus as recited in claim 1, in which at least one of the glue flap extending means and opposing flap extending means separates from the panel to which it is attached when the apparatus is folded.

5. An apparatus as recited in claim 1, in which the glue flap extending means defines four sides of an interior cell defined by the interior structure when the apparatus is folded.

6. An apparatus as recited in claim 1, further comprising at least one closure means for closing an end of the apparatus when the apparatus is folded, where the closure means defines one side of an interior cell defined by the interior structure when the apparatus is folded.

7. An apparatus as recited in claim 5, further comprising first and second inner closure means for closing first and second ends of the apparatus when the apparatus is folded, where the first and second interior closure means: (a) are attached to one of the front and rear panels; and (b) define two sides of the interior cell when the apparatus is folded.

8. An apparatus as recited in claim 7, further comprising first and second exterior closure means for closing the first and second ends of the apparatus, where the first and second exterior closure means: (a) are attached to the one of the front panel and the rear panel to which the first and second interior closure means are not attached; and (b) define a portion of the exterior structure.

9. An apparatus as recited in claim 1, in which the glue flap extending means is cut so that, when the apparatus is folded, the glue flap extending means so folds that first and second portions of the glue flap extending means are parallel to each other and third and fourth portions of the glue flap extending means are parallel to each other, where the first, second, third and fourth portions of the glue flap extending means define four sides of the interior structure.

10. A packaging apparatus having an interior structure for supporting an object and an exterior structure for protecting the object, comprising at least front, rear, left side, and right side panels, a glue flap connected to the right side panel, and opposing flap connected to the rear panel to which the glue flap is attached, means extending from the glue flap when the apparatus is unfolded for forming the interior structure when the apparatus is folded, and means extending from the opposing flap for supporting at least a portion of the interior structure when the apparatus is folded, where the opposing flap extending means is attached to at least one of the panels and the glue flap extending means is attached to at least another of the panels.

11. A packaging apparatus having an interior structure for supporting an object and an exterior structure for protecting the object, comprising at least front, rear, left side, and right side panels, a glue flap connected to the right side panel, an opposing flap connected to the rear panel to which the glue flap is attached, means extending from the glue flap when the apparatus is unfolded for forming the interior structure when the apparatus is folded, and means extending from the opposing flap for supporting at least a portion of the interior structure when the apparatus is folded, where at least one of the glue flap extending means and opposing flap extending means separates from the panel to which it is attached when the apparatus is folded.

12. A packaging apparatus having an interior structure defining a six-sided interior cell for containing an object and an exterior structure for protecting the object, comprising:

a. at least front, rear, left side, and right side panels;

b. a glue flap connected to the right side panel, an opposing flap connected to the rear panel to which the glue flap is attached;

c. means extending from the glue flap when the apparatus is unfolded for defining first, second, third, and fourth sides of the interior cell when the apparatus is folded; and d. first and second inner closure means for closing first and second ends of the apparatus when the apparatus is folded, where the first and second inner closure means i. are attached to one of the front and rear panels, and ii. define fifth and sixth sides of the interior cell when the apparatus is folded.

13. A packaging apparatus as recited in claim 12, further comprising first and second exterior closure means for closing the first and second ends of the apparatus, where the first and second exterior closure means: (a) are attached to the one of the front panel and the rear panel to which the first and second interior closure means are not attached; and (b) define a portion of the exterior structure.

* * * * *